US006006478A

United States Patent [19]

Hübner et al.

[11] Patent Number: 6,006,478

[45] Date of Patent: Dec. 28, 1999

[54] REINFORCED WINDOW FRAME

[75] Inventors: Otmar Hübner; Günter Pielmeier, both of Bogen, Germany

[73] Assignee: Thyssen Polymer GmbH, Bogen, Germany

[21] Appl. No.: 09/060,417

[22] Filed: Apr. 15, 1998

[30] Foreign Application Priority Data

Jun. 6, 1997 [DE] Germany ..... 197 23 970

[51] Int. Cl.[6] ..... E06B 3/00

[52] U.S. Cl. ..... 52/204.5; 52/734.2; 52/656.5; 49/183; 49/184; 49/185

[58] Field of Search ..... 49/183, 184, 185; 52/656.5, 734.2

[56] References Cited

U.S. PATENT DOCUMENTS 4,763,445 8/1988 Silverman ..... 49/176
5,632,118 5/1997 Stark ..... 49/181

*Primary Examiner*—Christopher T. Kent
*Assistant Examiner*—Nkeisha J. Maddox
*Attorney, Agent, or Firm*—Kane, Delsimer, Sullivan and Levy, LLP

[57] ABSTRACT

A window or a door has a frame structure and a U-shaped bar simultaneously serving as reinforcement section and a turn-tilt mechanism.

2 Claims, 2 Drawing Sheets

REINFORCED WINDOW FRAME

BACKGROUND OF THE INVENTION

1. Field of the Invention

The invention concerns a reinforced window frame consisting of plastic sections and a tilt-turn mechanism. The tilt-turn mechanism is equipped with a sliding bar and with gears, corner diverting mechanisms and a locking tenon.

2. Description of the Prior Art

Such windows, doors and the like are already known in the art. In a known manner, a reinforcement section is inserted into a plastic hollow section and equipped with an ironwork mechanism screwed into the plastic hollow section.

Such an arrangement has the disadvantage that the assembly and installation thereof are very costly and very time consuming.

Therefore, an object of the present invention is to provide a window frame that is stable and easy to assemble and install.

SUMMARY OF THE INVENTION

The advantages associated with the present invention include, in particular, the integration of the reinforcement section and the tilt-turn mechanism into a single unit, thereby avoiding the separate positioning and assembly of the two parts. Thus, the window is easier to install. For window casements of plastic sections with dimensions of up to approximately 1300 mm by 1400 mm, a separate reinforcement section is unnecessary in accordance with the present invention. For larger casement windows, such reinforcement is desirable, because the strength of the window casement, that is, its modulus of elasticity, is insufficient according to the reinforcement guidelines of the plastics industry.

The invention is described below in more detail and with the aid of the embodiment illustrated in FIGS. 1 and 2.

BRIEF DESCRIPTION OF THE DRAWINGS

Embodiments of the present invention will be described with reference to the accompanying drawing in which.

DETAILED DESCRIPTION OF THE PREFERRED EMBODIMENTS

Figure 1:
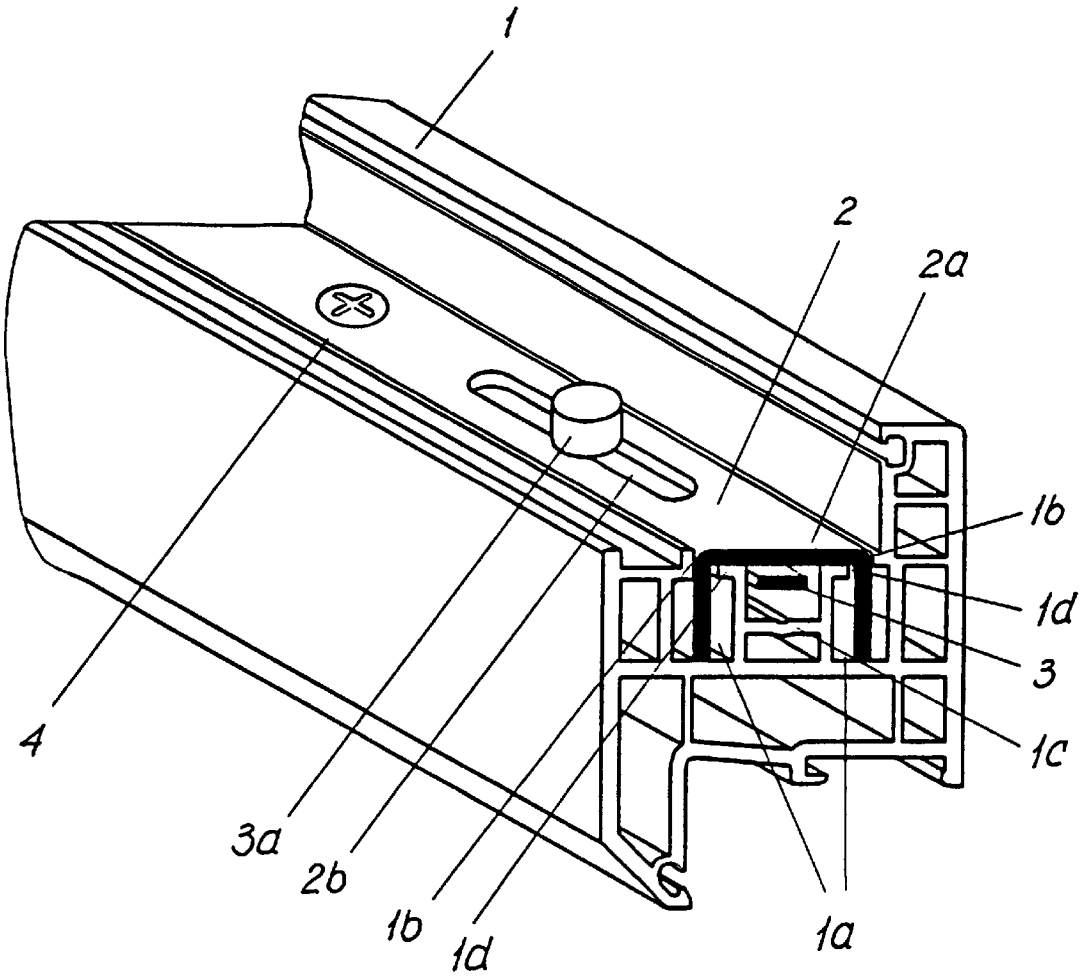
FIG. 1 is a perspective view of an embodiment section of a casement window frame according to the invention.

Those skilled in the art will gain an understanding of the invention from a reading of the following description of the preferred embodiments when read in conjunction with a viewing of the accompanying drawings of FIG. 1.

Referring to FIG. 1, there is seen an embodiment section of a casement window frame having a casement section 1, a combined reinforcement section 2, a sliding bar 3 and a locking tenon 3*a*. The reinforcement section 2 is placed in a channel 1*a* of the casement section 1 and lies on the contact surfaces 1*d* of a support section 1*c*. Support section 1*c* is approximately H-shaped, and the reinforcement section is held in place by two projections 1*b*.

Figure 2:
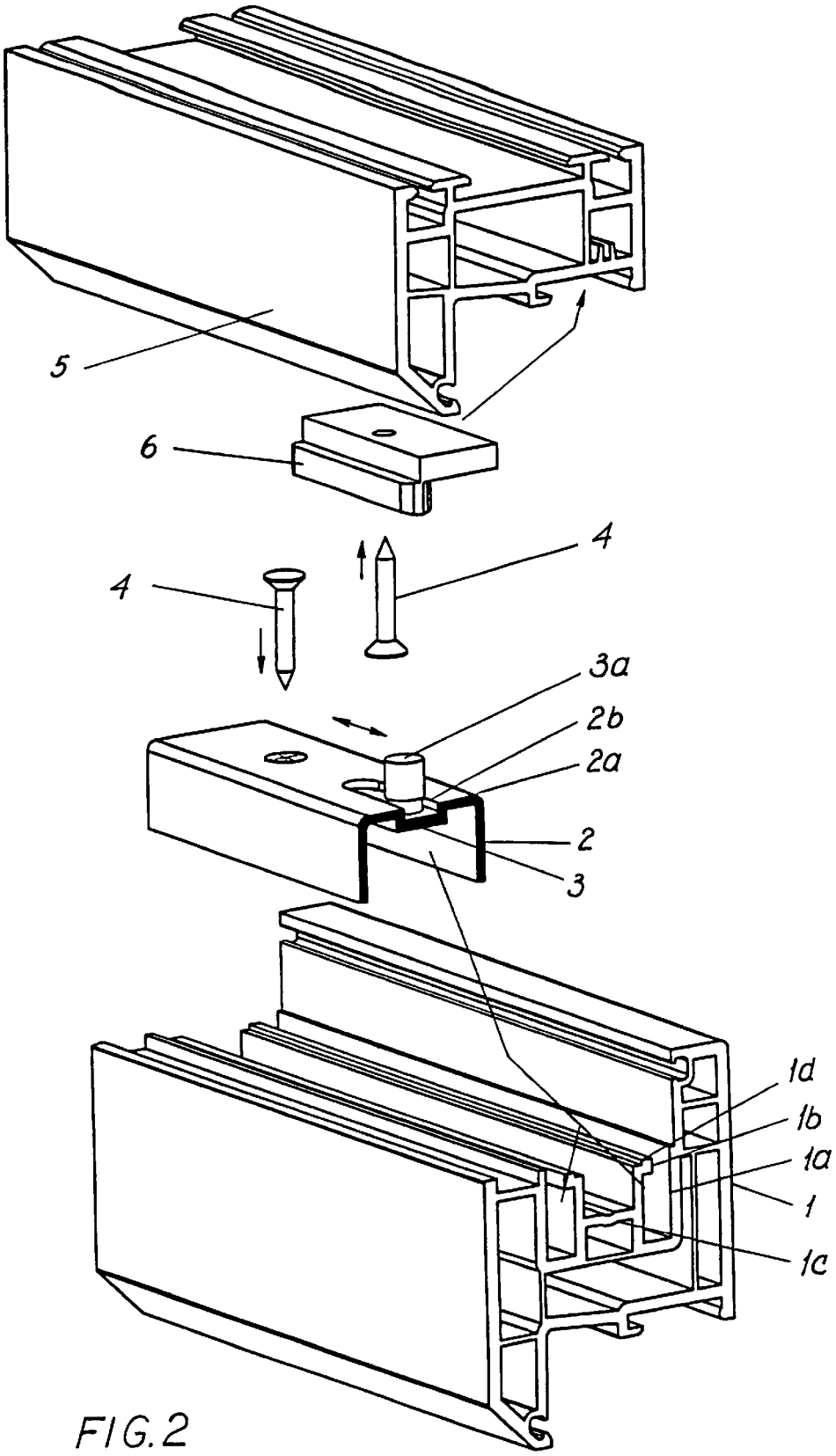
FIG. 2 is an exploded view of the embodiment casement window shown in FIG. 1.

Referring to FIG. 2, there is seen an exploded view of the embodiment casement window frame shown in FIG. 1. The locking tenon 3*a* is engageable with a mating member 6*a*, which secured to a casement 5 by a screw 4. The slider bar 3 and locking tenon 3*a* are movable along the length of reinforcement piece 2 in the direction indicated by the arrow. The slider bar 3 and locking tenon 3*a* thereby cause tilting and turning of casement 5 as is well known in the art.

The slider bar 3 of the tilt-turn mechanism runs below the cross leg 2*a* of the reinforcement section 2 but within the H-shaped support section 1*c*. The locking tenon 3*a* of the tilt-turn mechanism projects from the slider bar 3 into a mortise 2*b*, or lengthwise recess, of the reinforcement section 2. A fastening device 4, which may be, for example, a screw, fastens reinforcement section 2 and casement section 1. If sliding bar 3 moves below the cross leg 2*a* of the reinforcement section 2, the locking tenon 3*a* attached to the sliding bar 3 and the tilt-turn mechanism of the window frame are shifted either into the active or the rest position.

The window frame of the present invention has the necessary strength and is assembled in a simple manner with all of the desirable and required features of such a window. Naturally, the invention is not limited to the embodiment casement window frame consisting of plastic hollow sections as described above. The invention may also be successfully used in window frames consisting of other materials, such as wood, metal or some other combination of materials.

Accordingly, the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A reinforced window frame comprising:

plastic frame sections, each of said plastic frame sections having a receiving channel; and a tilt-turn mechanism;

wherein said tilt-turn mechanism comprises a reinforcement section being provided in said receiving channel of said plastic frame section and having a lengthwise recess for receiving a locking tenon of a sliding bar of a locking mechanism, said locking mechanism being slidably provided between said reinforcement section and said frame section.

2. The reinforced window frame according to claim 1, wherein said frame section includes a generally H-shaped support section, said support section including contact surfaces:

wherein the reinforcement section is generally U-shaped and is held in place by projections of said frame section projecting into the receiving channel and by said contact surfaces;

and wherein said reinforcement piece includes a cross leg, said sliding bar being movably positioned between said contact surfaces and below said cross leg.

* * * * *